United States Patent [19]

Larsson

[11] 4,106,282

[45] Aug. 15, 1978

[54] ESCAPEMENT MECHANISM FOR WATCH

[75] Inventor: Ake Lennart Larsson, Palos Verdes Estates, Calif.

[73] Assignee: Mattel, Inc., Hawthorne, Calif.

[21] Appl. No.: 745,071

[22] Filed: Nov. 26, 1976

[51] Int. Cl.[2] ..... G04F 7/04; G04C 3/00; G04B 15/00

[52] U.S. Cl. ..... 58/74; 58/23 D; 58/118; 74/1.5

[58] Field of Search ..... 58/21.13, 23 D, 31, 58/74, 76, 79, 109, 116–118, 121 R, 132; 73/6; 74/1.5

[56] References Cited

U.S. PATENT DOCUMENTS

| | | | |
|---|---|---|---|
| 443,165 | 12/1890 | Emery | 58/118 |
| 2,948,109 | 8/1960 | Witte | 58/109 |
| 4,050,236 | 9/1977 | Larsson | 58/74 |

*Primary Examiner*—Edith S. Jackmon
*Attorney, Agent, or Firm*—John G. Mesaros; Max E. Shirk; Stephen L. King

[57] ABSTRACT

A mechanical spring-powered hand-held digital stopwatch having a gear-operated decade counter display assembly, a spring-powered windup mechanism adapted to reset the counter during winding and a cam adjustable timing escapement mechanism, the escapement mechanism including an escapement gear actuating a balance through a limited pivotal angle, the angle of pivoting being governed by cam means interposed between a pair of arms carried by the balance.

4 Claims, 8 Drawing Figures

5
132
18
136
134
116
8
144
110
108
106
150
109
113
140
145
146
111
112
114
148
142
20
22
8
24
128
12
126
66
73
124
120
56
52
60
58
54
30
12
50
48
42
46
36
5

ESCAPEMENT MECHANISM FOR WATCH

CROSS-REFERENCE TO RELATED APPLICATION

This application is related to a patent application Ser. No. 745,285 filed concurrently herewith entitled "Mechanical Digital Stopwatch" by Richard Shih-Teng Chang and Edmund Emil Landsinger and assigned to the assignee of the instant invention.

BACKGROUND OF THE INVENTION

The background of the invention will be discussed in two parts.

FIELD OF THE INVENTION

This invention relates generally to stopwatches and more particularly to an escapement mechanism for a mechanical spring-powered hand-held digital stopwatch.

DESCRIPTION OF THE PRIOR ART

Prior art mechanical stopwatches have generally been of the expensive precision variety with precision escapement mechanism, utilizing hairsprings and the like for timing adjustment. Such escapement mechanisms require extremely close tolerances and generally utilize precision as jeweled bearings.

Other prior art is set forth in a separate communication to the patent office and is listed by way of illustration, and not of limitation. The present invention exemplifies improvements over this prior art.

SUMMARY OF THE INVENTION

Due to the competitive nature of children, many events participated in by two or more children involve an event which requires an elapsed time measurement. However, due to the expensive nature of existing stopwatches, the general availability of such devices to children has not heretofor been practical. A low-cost hand-held, mechanical relatively precise instrument would therefore be desirable to enhance the enjoyment of the children competing in such events.

It is accordingly an object of this invention to provide a mechanical spring-powered hand-held digital stopwatch.

It is another object of this invention to provide a mechanical stopwatch having adjustment means to enable the user to adjust the timing thereof against an electrical or electronic reference source.

It is still another object of this invention to provide a low-cost hand-held mechanical stopwatch escapement mechanism which is simple in construction and reliable in performance.

The foregoing and other objects of the invention are accomplished by providing a mechanical spring-powered hand-held digital stopwatch having a gear-operated decade counter display assembly capable of measuring an elapsed time down to one-tenth of a second. The spring-powered windup mechanism is adapted to reset the counter during winding. An escapement mechanism is provided which includes an escapement gear actuating a balance through a limited pivotal angle, the angle of pivoting of the balance being governed by cam means interposed between a pair of arms carried by the balance. The majority of the components are made from plastic to provide a light weight while the balance is made of metal with the pivot point of the balance being located at the approximate center of gravity thereof.

The features of the present invention which are believed to be novel are set forth with particularity in the appended claims. The present invention, both as to its organization and manner of operation together with further objects and advantages thereof, may best be understood by reference to the following description taken in conjunction with the accompanying drawings in which like-reference characters refer to like elements in the several views.

DESCRIPTION OF THE PREFERRED EMBODIMENT

Figure 1:
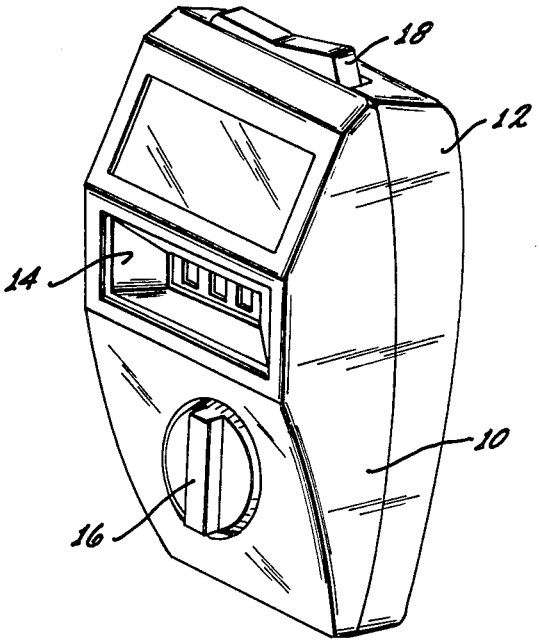
FIG. 1 is a perspective view of the mechanical digital stopwatch according to the invention.
Figure 2:
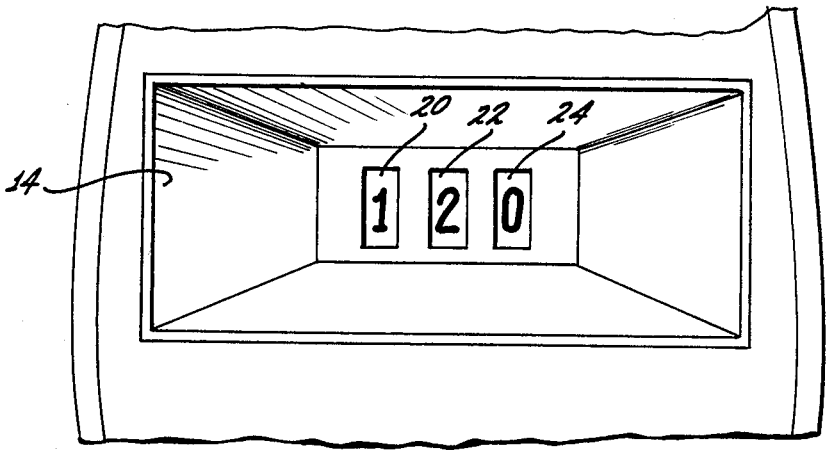
FIG. 2 is a fragmentary front view of the device of FIG. 1 showing the display portion thereof.

Referring now to the drawings and particularly to FIG. 1 there is shown a hand-held, spring-powered digital stopwatch according to the invention which includes a housing having a front housing 10 and a rear housing 12, the front housing 10 having a numeral or digital display portion 14 and a windup/reset knob 16. The top of the housing has a rocker arm start-stop switch 18, the switch 18 being positioned such that when the unit is held the switch 18 can be manipulated by the operator's thumb. As shown in FIG. 2, three digit display segments 20, 22 and 24 are located in the digital display area 14, the three digits being respectively from left to right the tens, units, and tenths of a second numerals.

Figure 3:
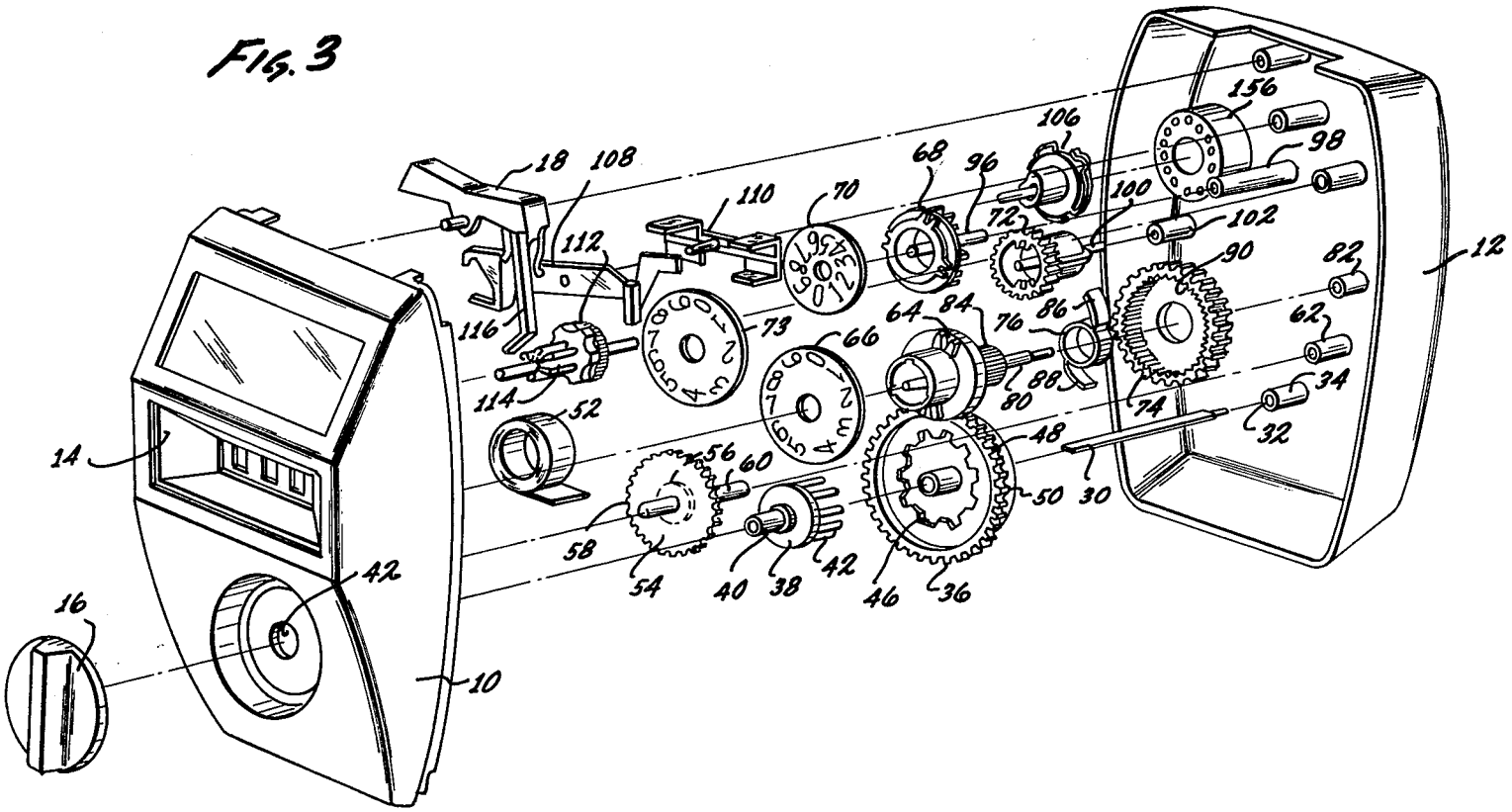
FIG. 3 is an exploded perspective view of the stopwatch of FIG. 1.

Referring now to FIG. 3, the various components of the stopwatch timing mechanism will be described. The components can be classified broadly into three subgroups, these being (1) the windup/reset mechanism, (2) the decade counter and display mechanism and (3) the escapement mechanism.

The windup/reset mechanism generally includes the knob 16 which is secured to metal shaft 30 which is mounted for rotation about aperture 32 in projection 34 formed integrally with interior surface of the rear housing 12. Carried by the shaft 30 is a main gear 36 and an actuating gear extender 38, the extender 38 having the shaft portion 40 thereof extending through the aperture 42 in the front housing 10 of the stopwatch device. The extender 38 is in the form of a disc with the shaft 40 extending axially in one direction and a plurality of fingers 44 extending in an opposite axial direction about the periphery of the main disc portion of the extender 38. The fingers 42 engage recesses 46 formed in the adjacent surface of main gear 36 for simultaneous movement therewith. Formed about the periphery of main gear 36 are radially extending gear teeth 48, while the under surface of the main gear 36 is provided with a reduced diameter drum surface 50 about which a negator spring 52 is wound upon rotation of shaft 30 by means of knob 16, the main gear 36 being loosely secured to shaft 30 and operated by extender 38. Coupled to, and operated by the gear teeth 48 of main gear 36 is an intermediary gear 54 having a small diameter pinion gear 56 and a large diameter gear 58 secured to the same shaft 60 which rotates within the aperture 62 formed integrally with the interior surface of rear housing 12.

The decade counter and display subassembly includes the "tenths" second gear 64 having secured to the face thereof a numeral-indicating disc 66, a "unit" gear 68 having the numeral-indicating disc 70 secured to the face thereof, a "tens" gear 72 having numeral-indicating disc 73 secured to the face thereof, a ratchet gear 74 and a pawl member 76.

In the assembled condition the "tenths" gear 64 has the disc 66 secured thereto for rotation therewith about shaft 80 which extends through the aperture of pawl member 76 and ratchet gear 74 to be rotatably secured within the aperture of projection 82 on the interior surface of rear housing 12. The aperture of pawl member 76 is secured to the serrated portion 84 of "tenths" gear 64, and extending circumferentially outwardly from pawl member 76 are a pair of deflectable pawls 86 and 88 adapted to engage, in one direction only, the internally toothed gear teeth 90 formed on interior surface of a recess within ratchet gear 74. If the gear 64 is being rotated in a counter-clockwise direction, the pawls 86 and 88 abut against the gear teeth 90 to rotate clutch gear 74 therewith. If, however, the gear 64 is rotated in the clockwise direction the circumferentially extending pawls 86 and 88 are deformed inwardly to ride over the gear teeth 90 without moving ratchet gear 74.

The "unit" gear 68 has affixed to the surface thereof the disc 70 with the gear 68 being rotatably mounted within the housing by means of its shaft 96 coacting with an aperture in projection 98 formed on the interior surface of rear housing 12. A similar disc 73 is secured to the "tens" gear 72 and the shaft 100 of gear 72 is positioned in the aperture of projection 102 on the interior surface of rear housing 12.

Figure 4:
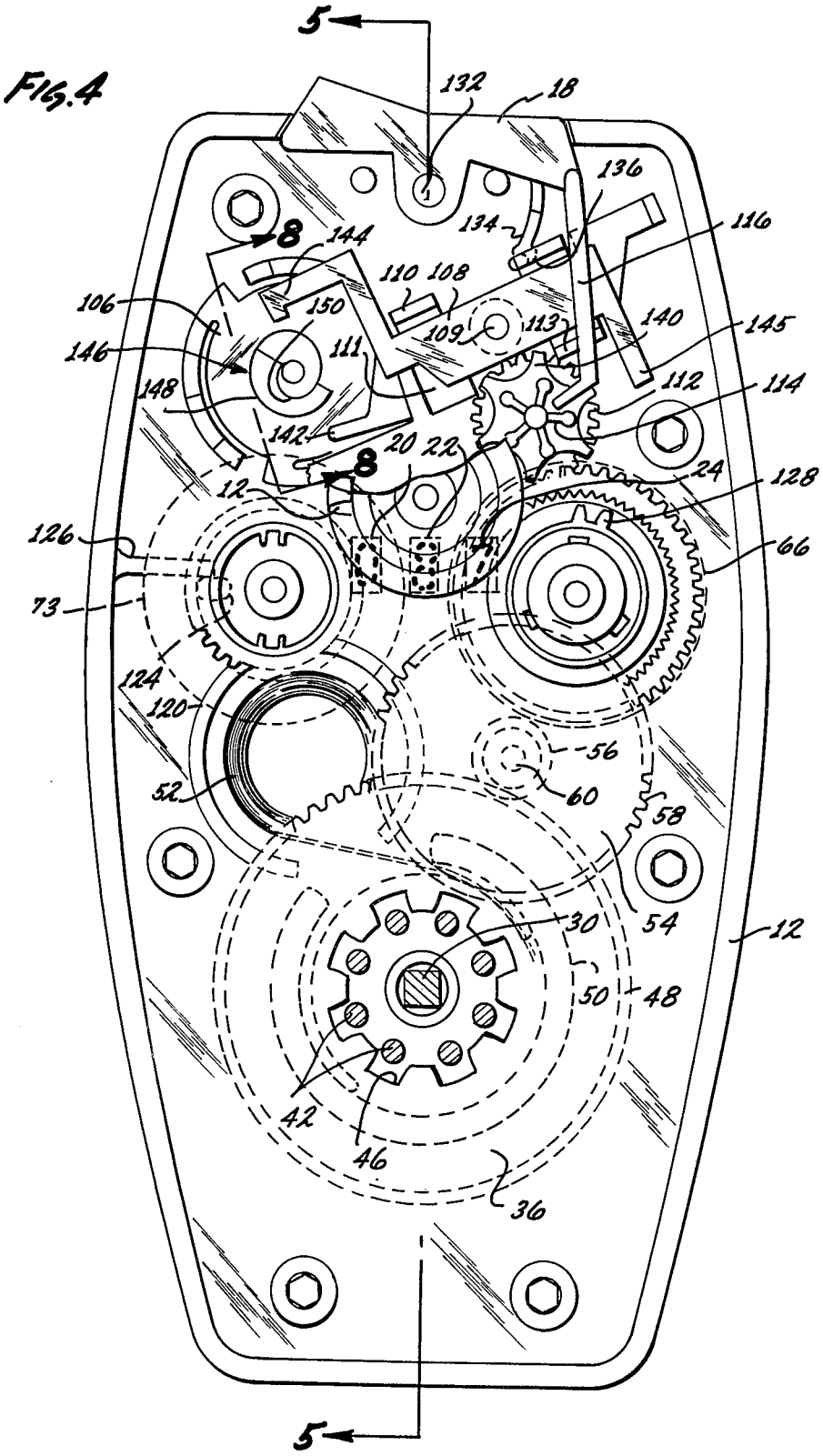
FIG. 4 is a front elevation (partially broken away) of the stopwatch of FIG. 1 with the front housing thereof removed.

As shown in FIGS. 3 and 4, the numeral-indicating discs 66, 70 and 73 have the numerals 0–9 positioned on the face thereof so that when the discs are in the assembled condition shown in FIG. 4, the numbers align within the window 20, 22 and 24 (shown in dotted lines) to provide a digital readout "087" as indicated. As can be seen, the numbers for the two outer discs 66 and 73 (shown in dotted lines) are inscribed on the discs with the numbers aligned circumferentially, while the numbers on the smaller center disc 70 have the numbers aligned in a radial direction to permit a true alignment for the digital readout as shown in FIG. 4.

The escapement mechanism of the digital stop watch device includes a timing adjustment cam member 106, balance 108, a balance saddle 110, and an escapement gear 112. The escapement gear 112 is also provided with a stop gear portion 114 which coacts with a stop arm 116 depending from rocker arm switch 18. Prior to discussion of the escapement mechanism, attention is directed to FIG. 4 where the various components shown in FIG. 3 are shown in assembled relationship within rear housing 12. As shown in FIG. 4, the rocker arm switch 18 is in the "off" position with the right side thereof depressed so that stop arm 116 integral therewith abuts between the ribs or gear teeth of stop gear 114 integral with escapement gear 112. Accordingly the escapement mechanism is inoperative and in its locked position.

The power source, which is the negator spring 52 is basically a coil of clock spring which sets within a generally C-shaped wall portion 120 formed within the interior surface of rear housing 12. The wall portion 120 has not been illustrated in FIG. 3 so as not to unduly complicate the figure. The inner diameter of wall 120 permits a certain amount of movement of the negator spring 52 which has the outer end thereof (shown in dotted lines) secured to the drum 50 of main gear 36 for rotation thereabout when shaft 30, and consequently, main gear 36, are rotated in a clockwise direction. This rotation, as previously discussed, is accomplished by means of rotation of knob 16 which has shaft 40 of extender 38 affixed thereto, the fingers 42 engaging the recesses 44 formed within the surface of main gear 36. The main gear 36 is fixed for rotation about shaft 30, although not coupled thereto, to guard against inadvertent counter-clockwise rotation of knob 16 which might damage spring 52. In the event the knob 16 is rotated in the counter-clockwise direction, the fingers 42 are resiliently deformed about the inner edges adjacent recesses 46.

Referring now to FIG. 4, the windup/reset operation will be discussed in detail. Prior to winding by rotation of knob 16, the switch 18 is in the position shown in FIG. 4, that is, with the right side thereof depressed so that stop arm 116 is positioned between the gear teeth of stop gear 114. Due to the coaction, or meshing, of the teeth of escapement gear 112 with the outer gear teeth of ratchet gear 74, the gear 74 remains stationary. Usually when winding is necessary, the display windows have some elapsed time measurement indicated therein and the coil spring 52 will only be partially wound around the drum 50 of main gear 36, or alternatively, if the display indicates all nines, the coil spring 52 will be completely unwound from around drum 50. In either event, upon rotation of the winding knob 16, the main gear 36 is wound in the clockwise direction as viewed in FIG. 4, the gear teeth 48 thereof engaging the gear teeth of pinon gear 56 of the intermediate gear 54 which rotates in a counter-clockwise direction. Due to the meshing of the large diameter gear 58 of the intermediary gear 54 with the "tenths" gear 66, the latter gear is rotated clockwise which carries with it pawl member 76 with pawls 86 and 88 moving over the internally toothed gear 90 of the interior gear surface of ratchet gear 74, which, at this point, is unable to move due to its meshing with escapement gear 112 which is locked by stop arm 116 (see also FIG. 6).

Referring to FIGS. 4–7, the gear operated decade counter and display mechanism will be described in conjunction with the windup/reset operation. The "tenths" gear 66 in turn is coupled to the "units" gear 68 which in turn is coupled to the "tens" gear 72, the "tens" gear 72 being provided on the under surface thereof with a downwardly depending stop projection 124 (shown in dotted lines in FIG. 4 and solid lines in FIG. 7) which is adapted to abut against a stop wall member 126 formed within the interior surface of rear housing 12. The stop projection 124 is positioned with respect to the corresponding disc 74 so that upon winding of the spring 52 to its maximum desired position about drum 50 of main gear 36, the digits displayed in windows 20, 22 and 24 are all set at zero with the stop projection 124 abutting against stop wall 126 as shown in FIG. 4 with the digit zero displayed in window 20.

As is conventional in decade counter gear arrangements, the "tenths" gear 66 is provided with a single gear pair 128, the gear pair 128 being adapted for coacting with the gear teeth 129 (see FIG. 7) about the periphery of the adjacent "units" gear 68 once per revolution. The "units" gear 68 is similarly provided with a single gear pair 127 (see FIG. 6) which meshes once per revolution with the gear teeth 131 of "tens" gear 72. The gear pair 127 of "units" gear 68 is on a different plane than the gear teeth extending about the periphery thereof which engages the gear pair 128. With respect to the "tens" gear 72, the stop projection 124 restricts its movement to only one revolution, the stop projection 124 being in the position shown in FIG. 4 abutting against one surface of stop wall 126 with the digit zero displayed in window 20, with the stop projection 124 abutting against the opposite surface of stop wall 126 when the digit nine is displayed in window 20. Consequently, the maximum time duration capable of being measured and displayed is 99.9 seconds utilizing a three-digit decade counter and display.

Since the decade counter gears are operatively coupled at all times notwithstanding the disablement of ratchet gear 74 as the main gear 36 is wound up by rotation thereof clockwise, the intermediary gear 54 rotates counter-clockwise, and due to its meshing with a coacting circumferential gear on "tenths" gear 66, the latter gear is rotated clockwise until the digit displayed in window 24 decreases to the next lower digit at which time the gear pair 128 engages the gear teeth on adjacent "units" gear 68 resulting in a display in window 22 thereof of one digit less. This rotation continues until the gear pair 127 engages the coacting gear teeth on "tens" gear 72 which would occur when the digit displayed in window 22 changes from zero to nine. Similarly, the digit displayed in window 20 will be incremented downwardly until the mechanism is fully wound and reset with all zeroes being displayed. At this point the operator is ready to use the device to measure the elapsed time duration of some timed event, such as a foot race or a bicycle race or the like.

At the start of the timed event, the operator then depresses the left side of rocker arms switch 18 which is pivoted at the center thereof about a pivot axis 132 formed within the housing 12. Downwardly depending, and integral with the rocker switch 18 is a spring portion 134 which coacts with an integrally formed stud 136 (shown in dotted lines adjacent thereto) in the interior surface of rear housing 12. Upon depression of the elevated portion of rocker switch 18, it is rotated in a counterclockwise direction carrying with it stop arm 116 which is taken out of engagement with stop gear 114 of escapement gear 112. At this point, all gears are under tension of the fully wound spring 52 and the escapement gear 112 is urged in a clockwise direction by the outer gear teeth of ratchet gear 74 meshing with the gear teeth of escapement gear 112. The escapement gear 112 has integral therewith a spider 140 having six web portions, the movement of which is restricted or governed by the rocking action of balance 108 and balance saddle 110.

Figure 6:
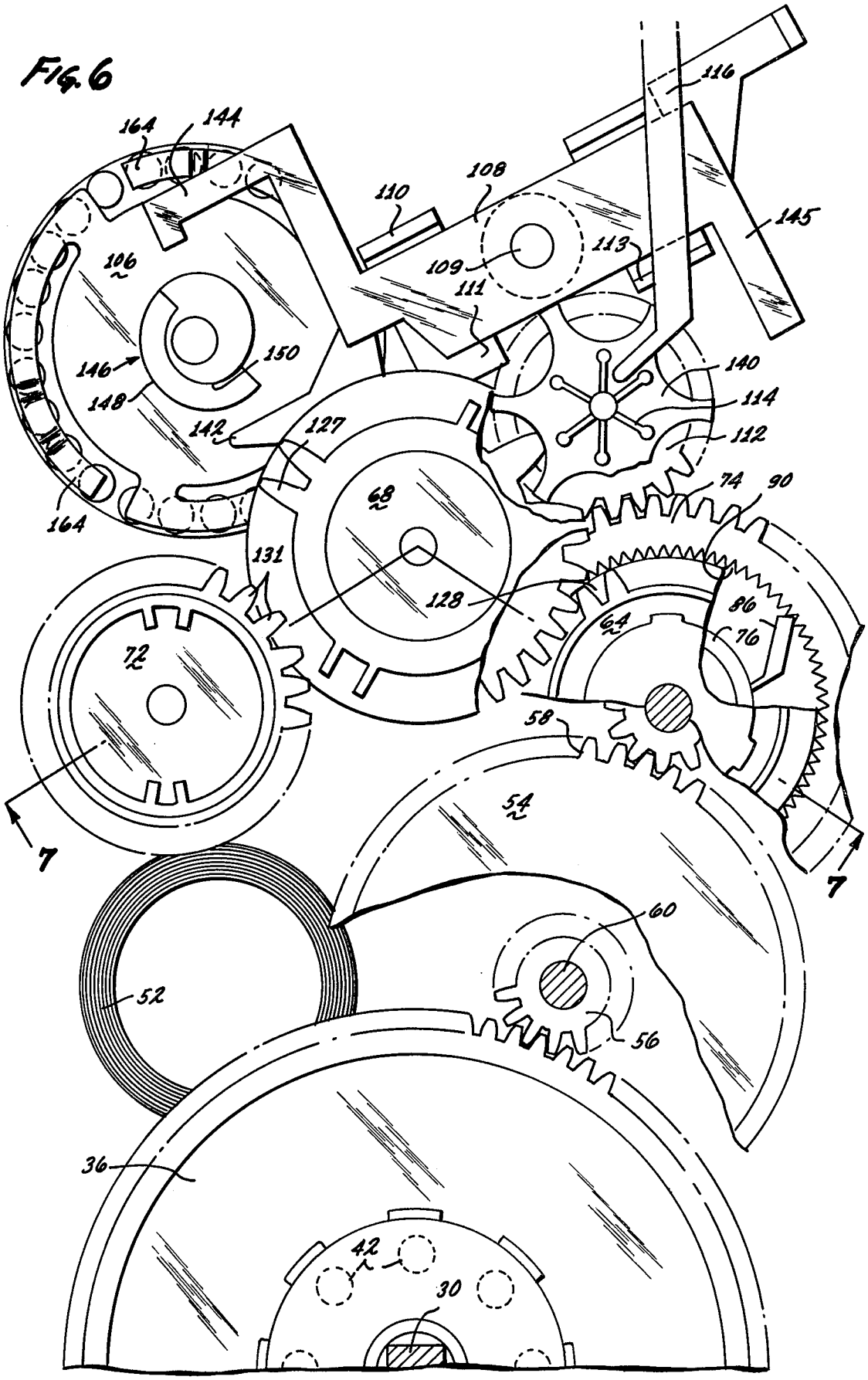
FIG. 6 is an enlarged partial front view of the view of FIG. 4, partially broken away.
Figure 7:
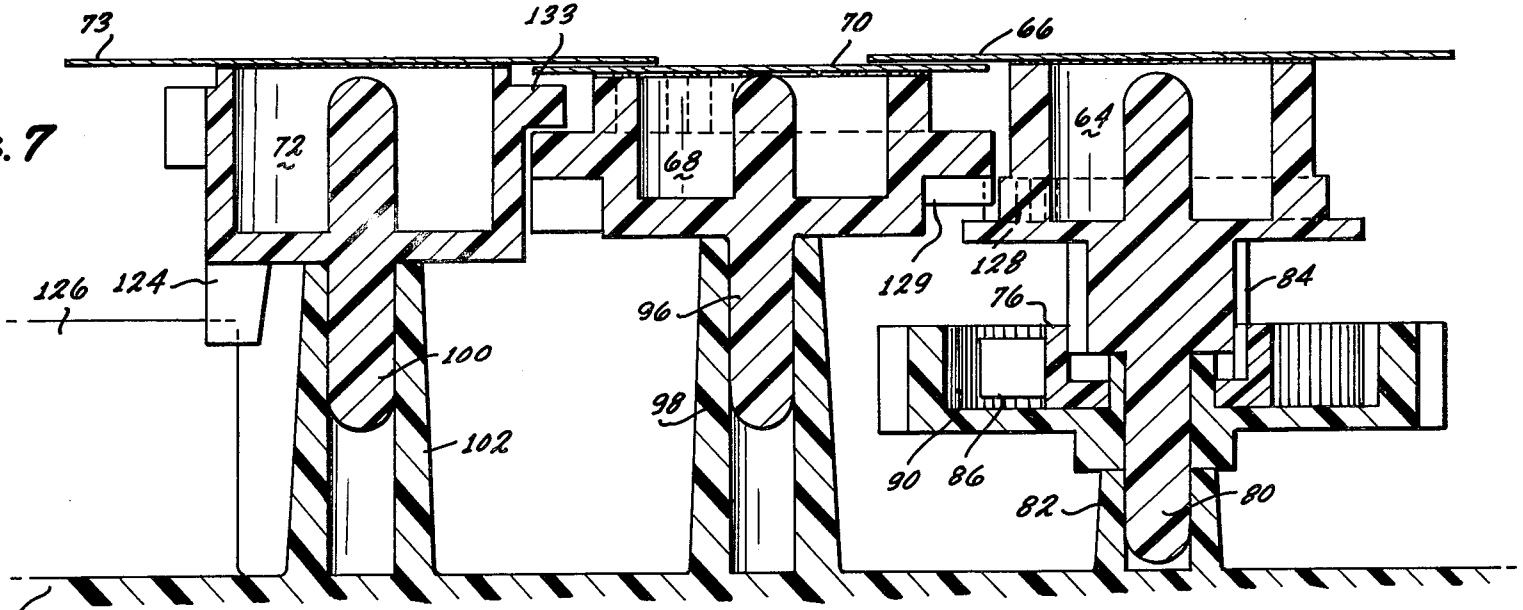
FIG. 7 is an enlarged cross-sectional view taken along line 7—7 of FIG. 6.

As shown in FIGS. 4 and 6, the balance saddle 110 is elongated in form and generally planar with one end thereof having a generally U-shaped configuration with the bight portion thereof within the plane of the elongated member and the arms thereof extending transversely thereto for surrounding a portion of balance 108. The other end of saddle 110 has a generally L-shaped configuration with one transverse section adapted to partially engage the adjacent edge of balance 108. Although the balance saddle 110 is made of plastic, the balance 108 is preferably made of metal to provide a pendulum or balance of substantial mass compared to the moving parts to effect more precise movement of the escapement mechanism. The lower edges of balance saddle 110 form pallets 111 and 113 which abut against the teeth of spider 140 of escapement gear 112.

Figure 8:
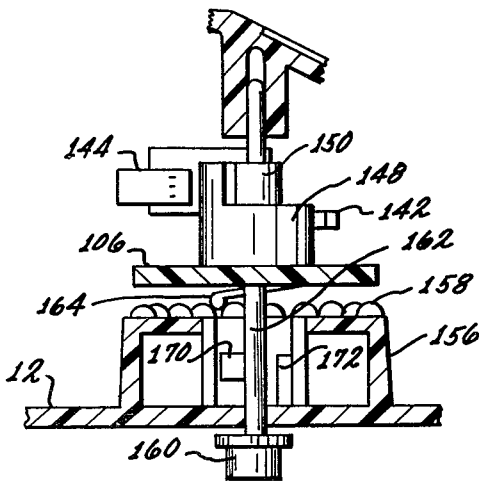
FIG. 8 is a cross-sectional view of the escapement mechanism taken along line 8—8 of FIG. 4.

The balance 108 has a generally bar-shaped main body member with a generally U-shaped end having generally parallel arms 142 and 144 extending longitudinally from pivot axis 109, the arms 142 and 144 being adpated to coact with opposing surfaces of the timing adjustment cam member 146 which is positioned between the opposing arms. At the opposite end of the main body member, the balance 108 is provided with a counter-balancing extension 145, the balance 108 having the mass thereof so configured that the pivot axis 109 is at the approximate balance point thereof. As more clearly shown in FIG. 8, the balance arm 142 is offset from the balance arm 144 with both arms being in parallel planes, the arm 142 coacting with the lower semi-circular surface 148 of cam 146 while the arm 144 coacts with an upper cam surface 150 formed integral with lower surface 148. As can be seen in FIGS. 4 and 6, the balance 108 along with balance saddle 110 are both adapted to pivot through a limited pivotal angle of movement about pivot axis 109, the balance saddle 110 having the pallets 111 and 113 thereof adapted to be rocked by the spider 140 to thereby carry with it balance 108. In actual construction, there is a certain amount of play or tolerance between the edges of the main body portion of balance 108 and the adjacent engaging portions of the saddle 110, the speed of the rocking of balance 108 being determined by the position of cam 146 which varies the distance between arm 144 and the coacting cam surface 150 as well as the distance between arm 142 and the coacting cam surface 148 of cam 146. This variation of distance is translated into a variation of angle of pivoting of balance 108 which is correspondingly translated into an adjustment or variation of the speed of rotation of escapement gear 112.

With the rocker arm switch 18 in its "on" positon and with the timing adjustment cam 146 being set in the position indicated in FIG. 4, the main spring 52 is rotating main gear 36 in a counter-clockwise direction which ultimately results in the escapement gear 112 being rotated in a clockwise direction until the first spider tooth abuts against the pallet 113 formed in the adjacent U-shaped portion of balance saddle 110 thereby rotating balance 108 in a counter-clockwise direction about its pivot axis 109 until arm 144 thereof abuts against the cam surface 150 of adjustment cam 146. At this point, the pallet 111 formed in adjacent L-shaped portion of saddle 110 is carried downwardly to position itself in the path of the next spider tooth of spider 140. This spider tooth then urges against pallet 111 to force balance 108 in a clockwise direction until arm 142 abuts against surface 148 of adjustment cam 146. The teeth of spider 140 are sequentially advanced one-sixth of a rotation for each full rocking cycle of balance 108, the angle of pivoting and consequently the speed of movement of balance 108 being determined by the amount of travel required for arms 142 and 144 to engage the respective cam surfaces 148 and 150.

Figure 5:
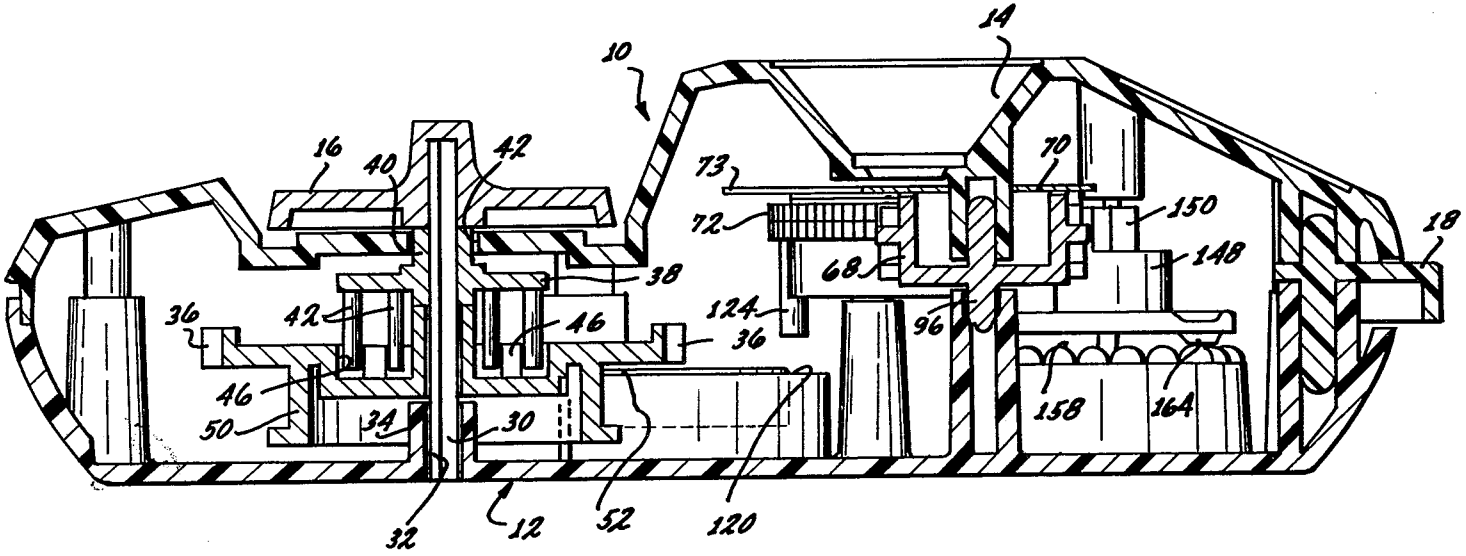
FIG. 5 is a cross-sectional view taken along line 5—5 of FIG. 4 with the front housing of the stopwatch shown in its assembled position.

As better illustrated in FIGS. 3, 5 and 6, the interior surface of housing 112 is provided with an interior cup-shaped portion 156 which has formed on the surface thereof peripherally positioned detent teeth 158. A timing adjustment knob 160 has a shaft 162 extending through the rear surface of housing 12 through the center of cup 156 to support the cam member 106 along with cam 146. The cam member 106 is generally disc shaped with three peripherally extending flexible prongs 164 having the free ends thereof ball-shaped extending downwardly to frictionally engage detent means 158. In order to adjust the timing, the operator rotates knob 160. Then after resetting and winding the mechanism, he utilizes a reference such as an electric clock with a sweep second hand. Upon observing the sweep second hand movement to a predetermined reference position, the operator then actuates rocker switch 18 to start movement of the digital mechanism. Upon completion of the desired cycle, such as 30 seconds, the operator then depresses the stop side of rocker switch 18 to stop the digital mechanism. He then takes a reading to determine whether the digital display is above or below the referenced time duration, and if need be, again rotates knob 160 to reposition the path length of cam surface 150 coacting with arms 142 and 144 of escapement arm 108. As shown in FIG. 4, the shaft 162 carries a projection 170 extending radially therefrom which coacts with an abutment 172 formed integrally within the interior of cup member 156. The abutment 172 is provided to limit the movement of shaft 160 to a rotation of less than 360 degrees. This permits the substantial portion of cam surfaces 148 and 150 to be utilized to regulate the length of travel of escapement arm 108 during pivotal movement thereof.

As can be seen, what has been provided is a mechanical digital stopwatch mechanism, spring-operated, with means for resetting the mechanism to "zero" and other means for precisely adjusting the timing by utilization of a rotary cam surface in a low-cost hand-held unit.

While there has been shown and described a preferred embodiment, it is to be understood that various other adaptations and modifications may be made within the spirit and scope of the invention.

What is claimed is:

1. In a mechanical watch for measuring a period of elapsed time, the combination comprising:

a housing having a display window;

spring means within the housing;

windup means for winding said spring means;

an output display means for indicating the elapsed time measurement;

an escapement mechanism having a balance pivotable through a predetermined angle;

cam means coacting with said balance and adjustable to set said predetermined angle;

other means coupling said spring means, said display means and said escapement mechanism; and switch means operable to enable said spring means to actuate said display means under control of said escapement means through said other means.

2. The combination according to claim 1 wherein said balance has a generally U-shaped end forming a pair of arms and said cam means is positioned between said arms for adjusting said predetermined angle.

3. The combination according to claim 2 wherein said cam means is a cam member rotatable on an axis parallel to the axis of pivoting of said balance.

4. The combination according to claim 3 wherein said cam member has first and second coaxial cam surfaces and the arms of said balance are offset with one arm coacting with said first cam surface and the other arm coacting with said second cam surface.

* * * * *